364-420
10/14/80 OR 4,228,508 SR

United States Patent [19]
Benthaus

[11] 4,228,508
[45] Oct. 14, 1980

[54] AUTOMATIC LONGWALL MINING SYSTEM AND METHOD

[75] Inventor: Friedrich Benthaus, Esse-Bredeney, Fed. Rep. of Germany

[73] Assignee: Bergwerksverband GmbH, Essen, Fed. Rep. of Germany

[21] Appl. No.: 947,179

[22] Filed: Sep. 29, 1978

Related U.S. Application Data

[63] Continuation-in-part of Ser. No. 892,165, Mar. 31, 1978, abandoned.

[30] Foreign Application Priority Data

Apr. 1, 1977 [DE] Fed. Rep. of Germany ..... 2714506

[51] Int. Cl.[2] ..... G06F 15/20; E21C 41/00
[52] U.S. Cl. ..... 364/420; 299/1; 364/505
[58] Field of Search ..... 364/420, 424, 100, 400, 364/105, 505; 173/1, 2, 4, 7; 299/1, 10, 30; 175/24, 26, 40, 50, 57, 62

[56] References Cited

U.S. PATENT DOCUMENTS

| | | | |
|---|---|---|---|
| 3,362,750 | 1/1968 | Carnegie | 299/1 |
| 3,531,159 | 9/1970 | Schmidt | 299/1 |
| 3,922,015 | 11/1975 | Poundstone | 364/420 X |
| 3,996,452 | 12/1976 | Schulze et al. | 364/105 |
| 4,008,921 | 2/1977 | Czauderna et al. | 299/1 |
| 4,023,861 | 5/1977 | Schnell | 299/1 |
| 4,033,626 | 7/1977 | Dinkelbach | 299/1 |

*Primary Examiner*—Joseph F. Ruggiero
*Attorney, Agent, or Firm*—Michael J. Striker

[57] ABSTRACT

A power loader having upper and lower cutting drums travels along the length of a face conveyor. Seam-top and seam-bottom sensors mounted on the power loader sense the heights of the true seam-top and seam-bottom. The data produced by these sensors during machine travel is not used to directly change the heights of the upper and lower cutters in the manner of an immediate-response automatic interface-follower system. Instead, to prevent the system from reacting and/or overreacting to changes in interface conditions, including changes which are physically insigificant and/or which, if fully reacted to, would exceed the floor and roof-negotiating abilities of the equipment, the system follows a preestablished interface-shape program. However, the true seam-top and seam-bottom height data from the sensors is fed into the process-control computer of the system, and used to modify and update the stored interface-shape program in a gradual ongoing manner. The computer ascertains, relative to predetermined criteria relating to the permissible rate of interface-shape program change in going from one power-loader working trip to the next, how much of the ascertained error in the interface-shape program can safely be eliminated per working trip for the successive working trips of the machine. And the erroneous intervals of the stored interface-shape program are then changed by such amounts during successive working trips, to gradually and stepwise dose out over a plurality of working trips the corrective reduction in the amount of the error exhibited by the stored interface-shape program.

12 Claims, 9 Drawing Figures

SHIFT IN SEAM

| | | v | w | t | s | r | q | p | o | n | m | l | k | j | i | h | g | f | e | d | c | b | a | | | | | | |
|---|---|---|---|---|---|---|---|---|---|---|---|---|---|---|---|---|---|---|---|---|---|---|---|---|---|---|---|---|---|
| OLD BOTTOM-CUT PROGRAM | A | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| PROGRAM ERROR | B | -20 | -30 | -42 | -50 | -60 | -70 | -80 | -90 | -100 | -110 | -120 | -130 | -140 | -150 | -160 | -170 | -180 | -190 | -200 | -150 | -100 | -50 | 0 | 0 | 0 | -50 | 0 | 0 |
| | | | | | | | | | | | | | | | | | | | | | | | | | | | | | |
| 1st NEW PROGRAM PROPOSED | C | -20 | -30 | -40 | -50 | -60 | -70 | -80 | -90 | -100 | -110 | -120 | -110 | -100 | -90 | -80 | -70 | -60 | -50 | -40 | -30 | -20 | -10 | | | | | | |
| 2nd NEW PROGRAM PROPOSED | D | -20 | -30 | -40 | -50 | -60 | -70 | -80 | -90 | -110 | -110 | -108 | -99 | -90 | -81 | -72 | -63 | -54 | -45 | -36 | -27 | -18 | -9 | | | | | | |
| . . . | | | | | | | | | | | | | | | | | | | | | | | | | | | | | |
| ACCEPTED NEW PROGRAM | L | -19 | -19 | -19 | -19 | -18 | -17 | -16 | -15 | -14 | -13 | -12 | -11 | -10 | -9 | -8 | -7 | -6 | -5 | -4 | -3 | -2 | -1 | | | | | | |

FIG. 9

AUTOMATIC LONGWALL MINING SYSTEM AND METHOD

CROSS-REFERENCE TO RELATED APPLICATION

The present application is a continuation-in-part of my copending application Ser. No. 892,165 filed Mar. 31, 1978 entitled "METHOD AND APPARATUS FOR MONITORING AND CONTROLLING LONGWALL EXCAVATING EQUIPMENT," now abandoned.

BACKGROUND OF THE INVENTION

The present invention relates to automation of longwall mining equipment.

The desire for increased automation of longwall mining equipment is considerable, inasmuch as manual monitoring and control of equipment operation requires a high degree of attention, experience, and relatively fast judgement.

The basic type of automated longwall mining system proposed in the prior art (see, e.g., "Bretby Broadsheet, July/September 1968, No. 44, pp. 3–4") is fully automatic and responds directly and immediately to changes in detected geological conditions. For example, the heights of the actual top and bottom boundary surfaces of a seam being worked are continually detected by isotopic nucleonic sensors or sensitized picks, capable of sensing the boundary surface between seam-coal and adjoining rock based upon the difference in properties of the two materials at the opposite sides of each boundary surface. If during a working trip of the power loader, it is for example detected that the true seam top height is higher than the top cut surface presently being cut, the upper cutting drum of the power loader is automatically raised, in direct and immediate response to the detection of this discrepancy. Thus, as the power loader travels along the length of the coal face, the cutting drums, but especially the upper one, are automatically adjusted in height, in continual immediate response to ongoing detection of true seam-top height. In this way, supposedly, the upper cutting drum will form a roof surface which is perfectly coincident with the rock-coal interface or, in the case where a coal roof is required, parallel to and spaced a constant predetermined distance from the rock-coal interface. The logic of proceeding in such a manner is clear; it is to maximize the amount of coal won and minimize the amount of contaminating rock being cut.

Such automatic, immediate-response control systems are suitable in geographical areas where the coal-rock interface is very well defined, continuous and relatively constant. However, in for example Western Germany, this is seldom the case. Instead, the coal-rock interfaces are typically discontinuous and irregular. In such areas, the use of an automatic, immediate-response control system is simply impossible, first because the system would respond to every sensed fluctuation in interface height and be in a continual state of overreaction, and second because an immediate automatic-tracking response to the sizable irregularities encountered could create roof and/or floor surfaces which the face conveyor, power loader and self-advancing roof-support system would be incapable of negotiating.

A partial solution to this problem is set forth in U.S. Pat. No. 4,008,921 to Czauderna et al. In that system, before any coal-winning work begins, mineralogical measurements are performed at a plurality of locations along the longwall passage, to determine the shape of the coal-rock interface. From the measured data, an interface-shape program is developed, either manually or by computer. The interface-shape program is then stored and used to control the heights of the upper and lower cutting drums during the first, and a plurality of subsequent trips. By comparison with the actual physical interface, the interface represented by the interface-shape program is well defined, continuous and smooth. The longwall mining system then rigidly adheres to the interface-shape program for a plurality of working strips, until such time as the program used has become stale, relative to the actual interface conditions being encountered. Then, a new set of measurements are taken, a new interface-shape program is established, and so forth.

This system is automatic, to the extent that there is negative-feedback control of the heights of the upper and lower cutting drums, relative to the heights commanded by the interface-shape program. If geological or operating conditions cause the development of improper transverse inclination, i.e., not corresponding to the preprogrammed transverse inclination of the interface-shape program, the system automatically adjusts cutting-drum height, to correct the inclination error. However, the automatic correction of cut-surface height and inclination errors is a correction relative to the preestablished interface-shape program, and is not a correction relative to feedback data from interface sensors such as used in the type of automatic, immediate-response system referred to earlier.

While the semi-automatic system of U.S. Pat. No. 4,008,921 thus constitutes a partial solution to the problem in question, the clear disadvantage of this semi-automatic system is the need to stop operation and establish a new interface-shape program as soon as the old one has grown stale. Stopping operation is troublesome in itself. Furthermore, because of the understandable desire to retain the old interface-shape program as long as tolerable, the program may indeed be quite stale during the last few working trips of its use. Clearly, this is far from optimum. On the other hand, as already stated, a system which directly responds to ongoing detection of changing interface conditions would not be operative for the geologies in question.

SUMMARY OF THE INVENTION

Thus, it is the general object of the invention to provide a method for the automatic monitoring and control of longwall mining systems which can be used when the coal-rock interfaces are not well defined, continuous and smooth, but which is somehow automatically responsive to data generated by interface sensors.

According to the broadest concept of the invention, this is achieved as follows. The feedback data generated by the interface sensors is not, as in prior-art systems, used as command data, merely commanding that the cutters be raised or lowered in correspondence to this feedback data. Instead, the data generated by the interface sensors is used to change the stored interface-shape program in a preprogrammed manner which is of a gradual character such that the interface-shape program slowly or stepwise adapts itself to the changed interface conditions. In this way, the interface-shape program is continually updated, in a controlled and preprogrammed way, and therefore kept from going stale.

In the preferred embodiment of the invention, program error is continually ascertained during the course of one working pass. For the sake of clarity, program error should be distinguished from control error. For example, in the system of earlier mentioned U.S. Pat. No. 4,008,921 the error which is automatically corrected is error between the interface-shape program, on the one hand, and the actual heights of the cutting drums, on the other hand; this is control error, and is ascertained by comparing the sensed heights of the cutting drums against the heights commanded for the drums by the interface-shape program. In contrast, program error is the error between the interface-shape program, on the one hand, and the sensor-detected physical interface, on the other hand; it is ascertained by comparing the sensed heights of the top and bottom interfaces (not the sensed heights of the cutting drums) against the interface-shape program, and is then corrected by modification of the interface-shape program.

The character of the program used for the ongoing gradual updating of the interface-shape program will best be understood from the description of a preferred embodiment, further below. However, the importance of the gradualness of the updating should be immediately emphasized. Persons skilled in the control-systems art will understand that immediate, direct and full correction of the command program is the mere equivalent of letting the data generated by the interface sensors itself constitute the command program, and therefore would be inoperative for the same reasons as explained already. It is the gradual and stepwise character of the changing of the interface-shape program which makes the automatic control system of the present invention operative, i.e., for the geological situations in question. Furthermore, in the context of longwall mining equipment control, although automatic, immediate updating of the command program is the mere equivalent of using the interface-sensor data as the command program itself, gradual updating of the command program is not the equivalent of merely introducing sluggish response into the operation of a system whose command program is constituted by the interface-sensor data. For example, in negative-feedback systems which must cope with a great deal of insignificant disturbance, it is elementary to introduce sluggishness (i.e., damping) into the system's response, so that the automatic control system will not react and/or overreact to every disturbance presented to it.

In the discontinuous-interface context, one might accordingly be tempted to use the automatic interface-following technique of the prior art, but introduce response-sluggishness into the system, in an attempt to deal with interface irregularity in that way; unfortunately, however, that would not be operative either, for reasons which will become clearer further below. In contrast, the inventive concept of preprogrammed gradual and stepwise modification of the interface-shape program enables one to utilize the data from the interface sensors, without loss of operativeness.

In the preferred embodiment, the error in the interface-shape program is continually ascertained during one working trip of the power loader; i.e., during such trip, the data generated by the interface sensors is continually compared against the stored interface-shape program currently being followed by the system. No modification of the interface-shape program yet occurs during this working trip, in response to this interface-sensor data. Instead, the interface-sensor data is used to generate a new interface-shape program to be followed during the next working trip of the power loader, it being assumed that the interface-sensor data for the present working trip will also have a high degree of applicability for the next working trip. Furthermore, the interface-shape program developed for the next working trip is not a fully corrected one; i.e., the next-trip program does not merely correspond to the interface detected by the interface sensors. Instead, the next-trip program is only partly corrected relative to the interface-sensor data, and the correction required for the interface-shape program by the interface-sensor data is, in effect, dosed out gradually over a plurality of successive working trips. The advantage of updating the interface-shape program in this manner will become clearer from the description of the preferred embodiment, below.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 9 is a representation of the type of data considered and produced by the unit of FIG. 8, referred to in the description of the operation of this unit.

DESCRIPTION OF THE PREFERRED EMBODIMENTS

Figure 1:
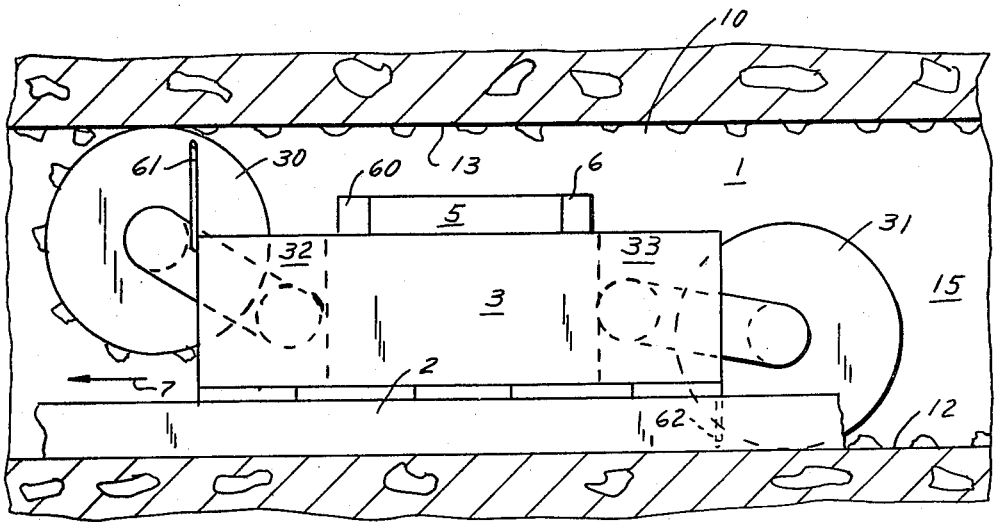
FIGS. 1–3 are respectively front, top and side views of a conventional longwall mining system, in which the power loader is of the cutting-drum type and the roof-support system is of the shielded self-advancing type.
Figure 3:
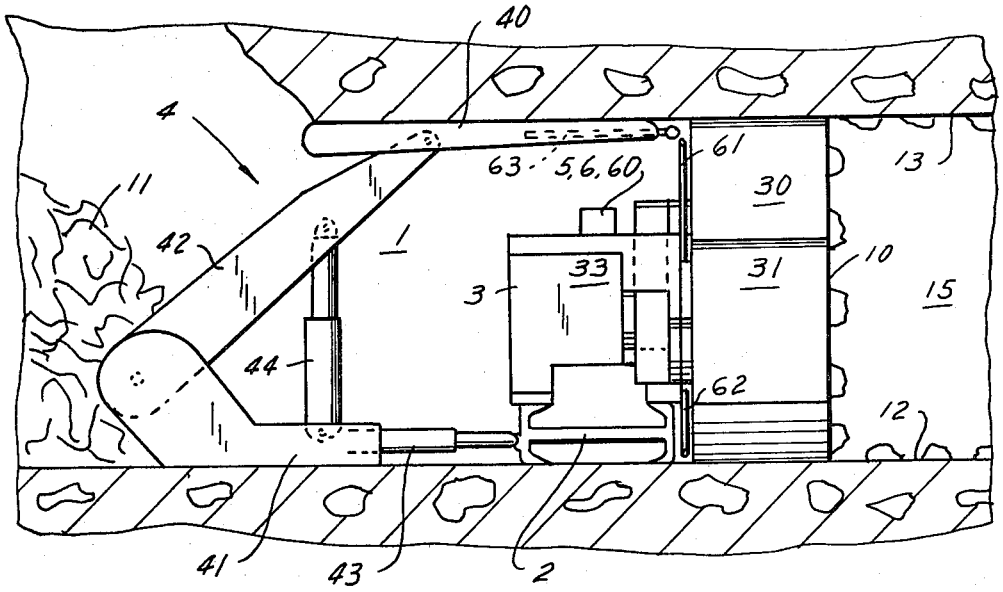
Figure 2:
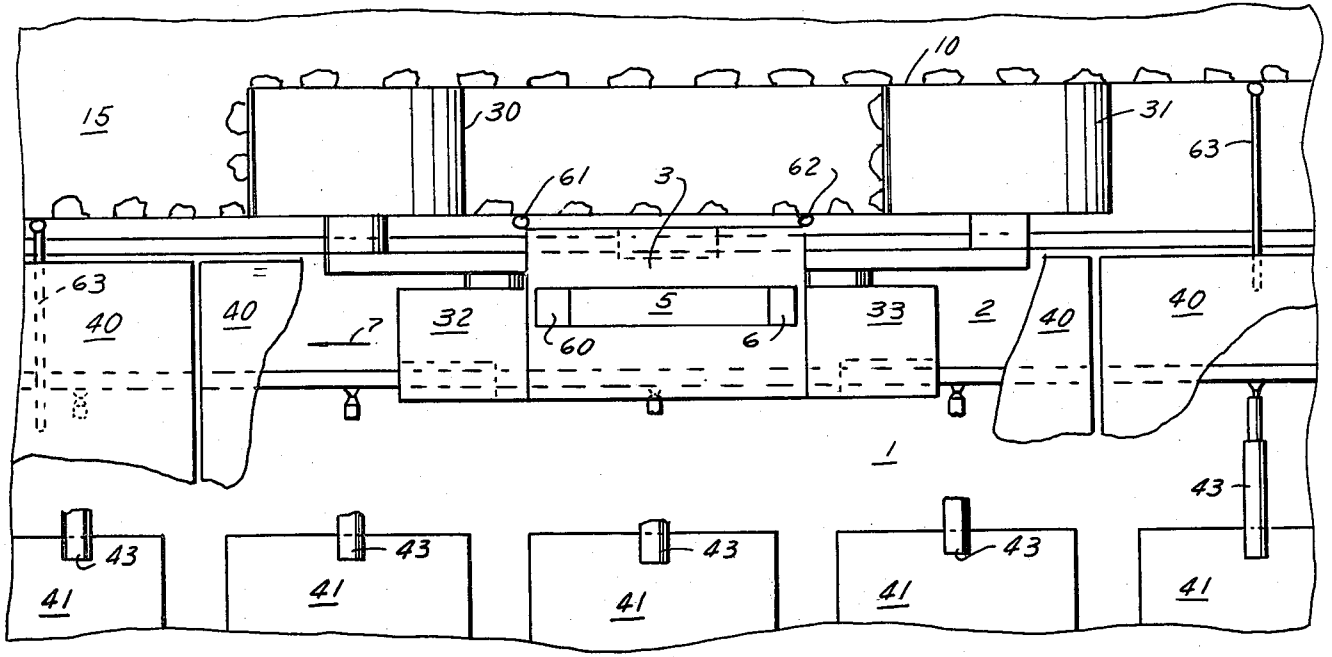

FIGS. 1–3 are respectively front, top and side views of a conventional longwall mining system. Numeral 1 denotes the passage formed by mining out the coal seam 15. Passage 1 is bounded (FIG. 3) at the bottom by the bottom cut or floor 12, at the top by the top cut or roof 13, to one side by the coal face 10, and to the other side by the gob 11. A face conveyor 2 is laid upon the floor 12, and supports and guides a power loader 3, here of the drum type. The power loader 3 comprises an upper cutting drum 30 and a lower cutting drum 31, by means of which is coal is won from the seam 15. Cutting drums 30, 31 can be swung upwards and downwards by swing motors 32, 33, and thereby be raised and lowered so as to be able to follow the ongoing course of the seam-bottom 12 and seam-top 13. The direction in which power loader 3 travels during its working, as opposed to its return, trips is denoted by arrow 7 in FIGS. 1 and 2. The working passage 1 is separated off from the goaf 11 by a system of roof-support units 4, here of the shielded type and comprising a roof-support plate 40, a base frame 41, between which a shield 42 is articulately mounted, and a hydraulic cylinder-piston unit 44 for supplying roof-support force. The roof-support units 4 are connected to the face conveyor 2 by self-advance cylinder-piston units 43.

Mounted on the power loader 3 is a process-control computer 5 which, however, could be located elsewhere and connected to the power loader 3 by means of transmission lines, or the like. The process-control computer serves to monitor and control the illustrated longwall mining equipment. To this end, the mining equipment is provided with various measured-value indicators and operating-state indicators. These include a position indicator 6 which indicates, during the ongoing travel of the power loader, where the power loader 3 is at any given moment, relative to the ends of the face conveyor 2. An inclinometer unit 60 mounted on the power loader 3 generates a signal indicative of the transverse inclination of the power loader, and thereby of the section of the face conveyor 2 presently supporting the power loader, and also a signal indicative of the forwards-backwards inclination of the power loader, and thereby of the face conveyor section supporting it. A seam-top sensor 61, for example of the isotopic nucleonic type or of the sensitized-pick type, senses the seam-top 13 whereas a seam-bottom sensor 62 senses the seam-bottom 12. A sensor 63 on each roof-support unit 4 measures the distance between the roof-support unit 4 and the coal face 10. Other measured-value indicators or operating-state indicators will also be provided, e.g., to sense the states (extended or retracted) of the self-advance cylinder-piston units 43 of the roof-support units 4; the states of the roof-support cylinder-piston units 44; the hydraulic pressure in such cylinder-piston units; the operating states of the face conveyor 2, power loader 3; the distances between face conveyor 2 and individual roof-support units 4, and between the face conveyor 2 and a non-illustrated reference line space from conveyor 2 in the direction towards previous working passes; and so forth. These need not be described in detail, because individually they are conventional and used conventionally.

Figure 4:
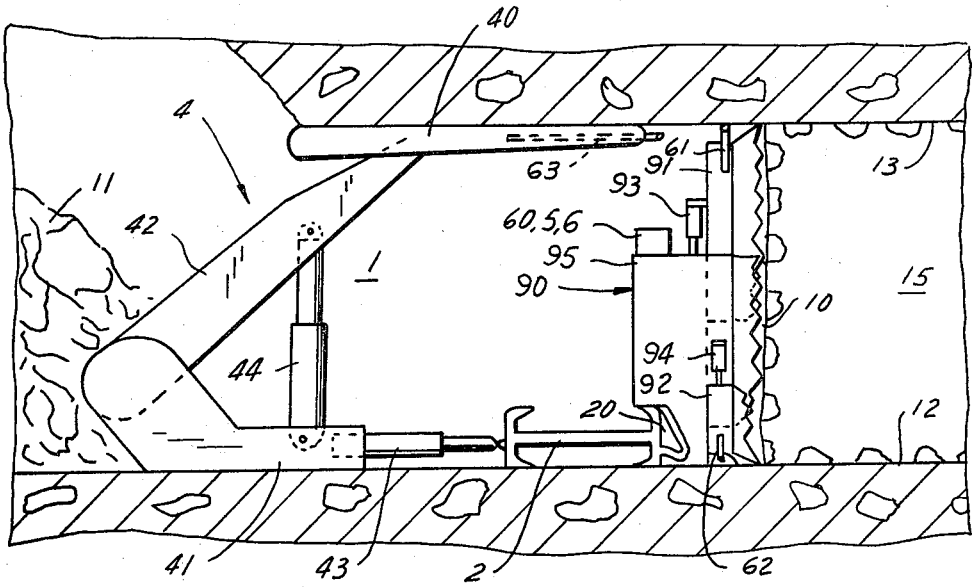
FIG. 4 is a view similar to FIG. 3, but with the power loader here being a coal plow.

FIG. 4 is a view similar to FIG. 3, but illustrating the use, instead of the drum-type power loader 3, of a coal plow 90 guided on a slide ramp 20 on the face conveyor 2. The coal plow 90 comprises a main body 95, on which is centrally mounted a top cutter 91 and, to either side thereof, two bottom cutters 92, with the heights of these cutters being adjustable via upper and lower adjusting cylinders 93, 94 so that these cutters can follow the seam-top and seam-bottom interfaces. Here, likewise, the mining machine is provided with a position indicator 6, inclinometer unit 60 and seam-top and seam-bottom sensors 61, 62, which feed information into a process-control computer 5 for the monitoring and control of the operation of the equipment.

Figure 5:
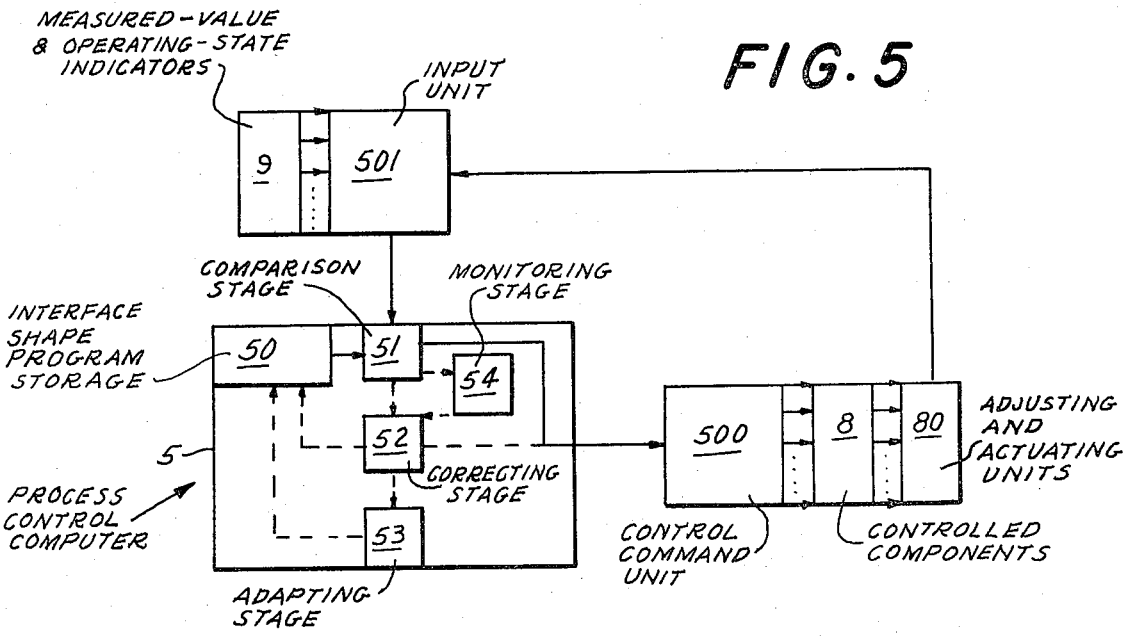
FIG. 5 is a simplified schematic block diagram of the inventive system.

FIG. 5 is a greatly simplified schematic block diagram of the inventive automatic monitoring and control system. Numeral 5 denotes the process-control computer of the system per se. Numeral 9 denotes, in toto, the various measured-value indicators and operating-state indicators, which serve to feed back into the control system data concerning current operation and detected geological conditions, in particular the data which has relevance for a possible updating of the interface-shape program. The thusly fed back data includes that from the seam-top and seam-bottom sensors 61, 62, the transverse and forwards-backwards inclination data from the inclinometer unit 60, the power-loader location data from the position indicator 6, and so forth.

In particular, all this feedback data from the measured-value and operating-state indicators 9 is transmitted to an input unit 501 which interfaces these indicators with the process-control computer 5 per se, e.g., converting the output signals of such indicators from analog to digital form, and so forth.

The input unit 501 transmits this feedback data, relating to a possible need for a change in the interface-shape program, to comparison stage 51. The comparison stage 51 also receives the command data of the present interface-shape program from the interface-shape program storage 50, and compares the existing program against the incoming feedback data, to ascertain the degree of error in the existing interface-shape program.

The program-error information generated by comparison stage 51 is applied to a correcting stage 52 which generates data indicative of what the corrected interface-shape program should in the future be. The correction data generated by correcting stage 52 is in part used to directly correct the program stored in storage 50, and in part transmitted through an adapting stage 53, which assures that those aspects of the program whose change must be effected gradually and stepwise are properly implemented.

A monitoring stage 54, connected between the comparison stage 51 and the correcting stage 52, serves to evaluate the program-correction data, with respect to the possibility of developing a new interface-shape program which would be unacceptable, either because the changes in the program would be too great or too small for the limits of the physical system; stage 52 ascertains, for example, whether the corrected interface-shape program, if actually followed, would cause the height-difference of the upper and lower cutting drums to become smaller than a predetermined value, i.e., to prevent the vertical height of the passage 1 from decreasing to such an extent that the power loader 3 would thereafter be incapable of negotiating it; likewise, stage 52 ascertains, for example, whether the corrected interface-shape program, if actually followed, would cause the height-difference of the upper and lower cutting drums to exceed their combined diameters, i.e., to prevent the cutters from attempting to open up a passage whose vertical height exceeds the power loader's cutting capability; and so forth.

All this relates to the processing of data which could create a need for a change in the interface-shape program being followed, and to the actual change in such program.

Additionally, input unit 501 receives control-error data from adjusting and actuating units 80 of the longwall mining system. Whereas program-error data relates to error in the interface-shape program being followed, control-error data relates to error in following the particular interface-shape program presently in effect. The adjusting and actuating units 80 include, for example, sensors indicating the present actual heights of the upper and lower cutters, the measured distance value from sensor 63, operating-state data concerning the states (extended or retracted) of the self-advancement cylinder-piston units 43 and of the roof-support cylinder-piston units 44, plus other such control-feedback data including, for example, the hydraulic pressures in such cylinder-piston units and in their hydraulic supply lines, the settings of their hydraulic control valves, relative-position data conerning the relative positions of the roof-support units 4 relative to the face conveyor 2, and so forth. This feedback data, relating not to possible changes in the interface-shape program, but instead relating to the system's accurate following of the program presently in effect, is likewise transmitted by input unit 501 to comparison stage 51, where it is compared against the data from the interface-shape program presently in effect, to ascertain control-error. And likewise, the control-error data is transmitted from comparison stage 51 to correcting stage 52 for the generation of corrective data relating to the corrections needed to bring present operation into line with the interface-shape program presently in effect. This data is in turn applied to a control command unit 500, which serves to convert this data into the form needed for controlling the operation of the physical system, e.g., for converting the digital data from stage 52 into corresponding analog positioning and control signals for the swing motors 32, 33 of the upper and lower cutters, into valve-control signals for the various cylinder-piston units, and so forth. Numeral 8 denotes, in toto, the thusly controlled actuating and adjusting components, i.e., the swing motors, the control valves, and so forth; and numeral 80, as already stated, denotes in toto the actually controlled components, i.e., the cutting drums, cylinder-piston units, and so forth.

Figure 7:
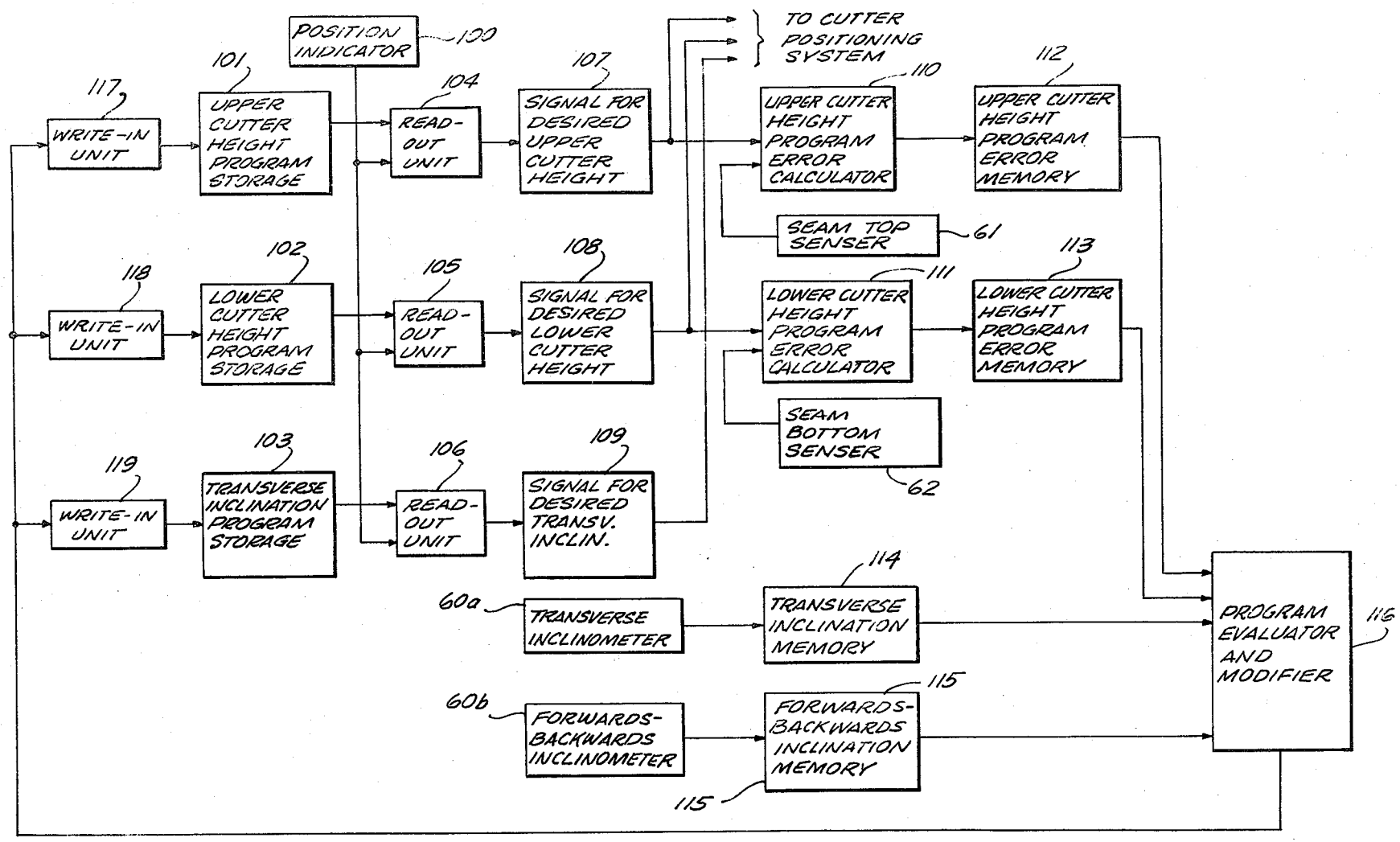
FIG. 7 is a detailed schematic block diagram of the part of the control system responsible for updating the interface-shape program.
Figure 8:
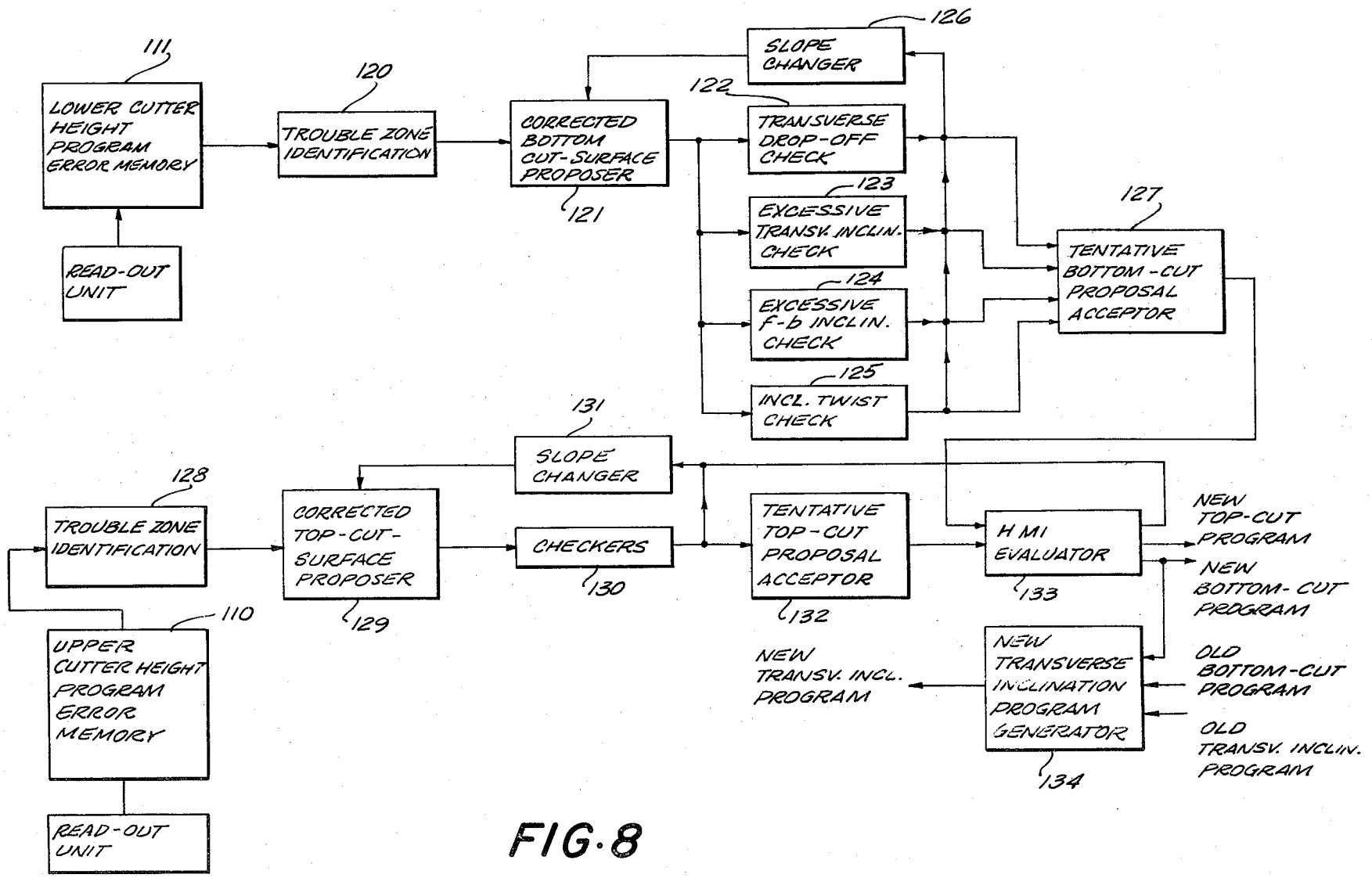
FIG. 8 is a detailed schematic block diagram of the program evaluator and modifier unit of FIG. 7.

As already stated, FIG. 5 is a greatly simplified schematic block diagram of the control system. FIGS. 7 and 8 are detailed block diagrams of the parts of the control system relating to program updating, but are discussed further below.

Figure 6:
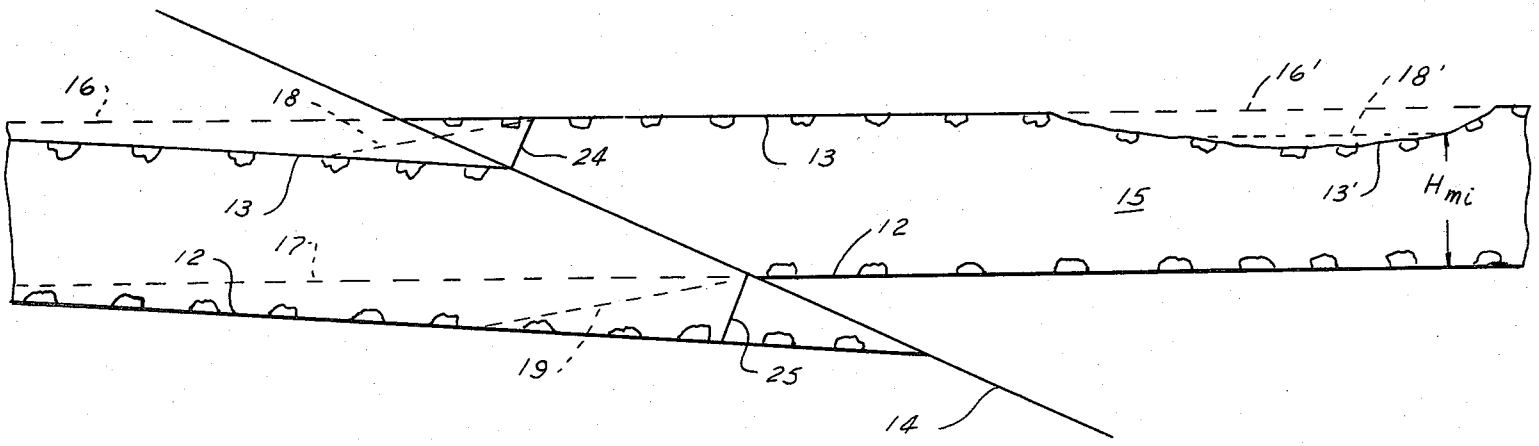
FIG. 6 is an illustration of two representative interface problems encountered in the course of working a seam, and of how these problems are dealt with by the inventive control system.

FIG. 6 depicts two representative problematic interface irregularities encountered when working seams having the type of geology in question. The travel direction of the power loader is right-to-left, during its working trips, as opposed to its return trips, it being assumed for simplicity that the power loader is of the unidirectional, not the bidirectional, type.

At the far right in FIG. 6, it will be seen that the top boundary surface of the coal seam 15 dips down for a limited interval. In the first type of prior-art system discussed earlier, wherein the system automatically follows the coal-rock interface as closely as possible, the system would attempt to follow this top-interface dip', and as a result, the vertical clearance of the passage being opened up would become too low, e.g., not tall enough for the power loader 3 to later pass through; as a result, the power loader 3 could become jammed or deadlocked in this not tall enough interval of the passage.

In the second prior-art system disclosed, that of U.S. Pat. No. 4,008,921, the system does not respond at all to this upper-interface dip 13', but instead rigidly adheres to the preselected upper interface-shape program, represented at 16', this program having been selected in advance of any coal-winning and having been based upon a limited number of manually performed measurements and tests. The clear disadvantage of the response of the second prior-art system, here, is that by rigidly following the preselected interface-shape program 16', the upper cutter removes a very considerable amount of contaminating rock.

In contrast, with the control system of the present invention, for this interval of the power loader's trip, the upper interface-shape program 16' is modified, to take into account as much as possible the sensor-detected dip 13' in the seam-top. For this interval of the upper interface-shape program, the program is altered to 18', i.e., so as to cut a minimal amount of rock, consistent with the limitation that the vertical clearance of the passage being formed not become smaller than a minimum value $H_{mi}$.

Preferably, in response to the sensor-detection of this dip 13', the affected interval of the interface-shape program is not immediately changed over to 18'. I.e., there is no change in operation at all, during the working trip during which this dip 13' was first detected, and instead the interface-shape program is altered to take this dip 13' into account not before the next subsequent working trip. Also, for such next working trip, the correction of the interface-shape program is not immediately complete, i.e., does not yet fully correspond to 18'; instead, there is a more gradual change in this interval of the upper interface program, so that the final new program 18' is brought into existence only over the course of a plurality of successive working trips. This is more fully explained further below.

Further to the left in FIG. 6, there is a shift in seam 15, along a shift-plane 14. This presents a considerably more complicated problem than the simple dip at 13'.

The prior art system of U.S. Pat. No. 4,008,921 would respond to this shift 14 as follows: Assume, for simplicity, that for the working trips previous to the one shown in FIG. 6, the actual seam-top was as shown at 16, 16' and the actual seam-bottom as shown at 12, 17, i.e., both perfectly horizontal, flat and parallel to each other. Assume, also, that the interface-shape program corresponded to this, and that the shift 14 is encountered for the first time by the system, during the working pass illustrated in FIG. 6. Because the system of that patent rigidly adheres to its preselected interface-shape program, it will not respond whatsoever to the conditions in the vicinity of shift plane 14. Instead, its upper cut will strictly follow the upper program 16, and its lower cut the lower program 17. Clearly, at the upper cut, the system will cut excessively into contaminating rock. Likewise, at the lower cut, the system will fail to cut a sizable quantity of coal. The only way to avoid this would be to stop the excavating equipment, perform new tests and measurements, and establish a new interface-shape program.

The difficulties which, in contrast, would result with the first prior-art system discussed are even more serious, because they would threaten operativeness. In the first prior-art system discussed, the upper and lower cutters are automatically and immediately lowered and raised in response to the sensor-detected changes in the seam-top and seam-bottom, here at the region of the shift plane 14. Accordingly, the upper cutter, after having followed the true seam-top 13, would be quickly lowered along a steeply descending cut line 24, and then as soon as possible again follow the true seam-top 13. Similarly, the bottom cutter, having followed the true seam-bottom 13, would be quickly lowered along a steeply descending cut line 25, and then as soon as possible again follow the true seam-bottom 12.

Persons skilled in the art will understand that this would be unacceptable. At the floor of the passage, the face conveyor, although flexible enough to follow a certain amount of vertical undulation of the floor surface, could not negotiate such a steep forwards-backwards drop-off as would be encountered at 25. Likewise, the system could not negotiate the amount of transverse drop-off which would be encountered, i.e., in going from the previous floor level 17 suddenly down to the new floor level at 25, 12. Furthermore, the self-advancing roof-support system would be unable to advance over this transverse drop-off floor situation. Similar difficulties, although perhaps not quite so drastic, would be encountered at the roof of the passage; i.e., the self-advancing roof-support system might be unable to negotiate this transverse step in the roof, as well.

From this explanation, it will be clear why automatic, immediate-response interface-following systems of the prior art are so completely unacceptable for the contemplated geologies, and also why the system of U.S. Pat. No. 4,008,921 represents an improvement relative to such prior art, despite its absence of any automatic response to changing interface conditions.

The problem represented by the shift-plane 14 in FIG. 6 is dealt with by the system of the present invention as follows: For simplicity assume that, for working trips previous to the illustrated one, the floor and roof were flat, horizontal and parallel as shown at 16, 17. Accordingly, for those working trips, the top and bottom interface-shape programs corresponded to 16, 17 at the zone now containing the shift. Assume also that, for all working trips subsequent to the illustrated one, the true seam-top and seam-bottom are as shown in FIG. 6.

When the inventive system encounters the shift-plane problem shown in FIG. 6, and has achieved its final automatic adjustment with respect to it, the upper and lower cut surfaces will be as shown at 18, 19, in this region. I.e., upstream of the problem region, the interface-shape program will still correspond to 12, 13, and downstream of the problem region, the interface-shape program will likewise correspond to the true seam-bottom and -top 12, 13. The roof and floor program at 18, 19 will be such that the face conveyor, power loader and self-advancing roof-support system can negotiate the limited vertical variation of floor and roof in the shift-plane vicinity.

However, whereas 18, 19 in FIG. 6 represents the final version of the changed interface-shape program in the shift-plane vicinity, the actual changeover from the original interface-shape program 16, 17 to the final program 18, 19 is gradual and stepwise, being implemented gradually during the course of a succession of working trips. The advantage of this at the floor will be understood: Although the final floor program 19 will not place an excessive demand upon the flexibility of the face conveyor when steady-state operation has been achieved, if the final floor program 19 were to be implemented immediately, i.e., in the working trip following first detection of the shift-plane problem, the transverse drop-off of the system, in going from old floor program 17 down to new floor program 19, 12, would be more than the system could safely negotiate. Thus, although the downwards slope of final floor program interval 19 is much less than that of a prior-art cut surface 25, it would not be acceptable as the first version of the adjusted floor program. Instead, the first version of the adjusted floor program must slope downwards even less than at 19, and then during successive working trips, its downward slope is gradually and stepwise increased, until finally the slope shown at 19 is achieved, thereafter constituting steady-state operation.

Likewise, the final roof program 18 will, typically, not be implemented all at once, but instead will be achieved gradually over a succession of working trips, starting with a roof program interval whose downward slope is not so great as at 18, but gradually increases, during successive working trips, until the downward slope at 18 is reached. In a sense, the restrictions placed upon changes in roof program are not so severe as those placed upon floor-program changes, because for example there is per se no problem of transverse drop off, and instead somewhat less severe restrictions relating to the ability of the self-advancing roof-support system to negotiate the roof surface being formed. Therefore, for example, the final version of the adjusted interval 18 of the roof program can often be achieved somewhat ahead of the final version of the adjusted interval 19 of the floor program, i.e., one or more working-trips sooner.

The just given explanation of how the inventive system copes with the problem presented by the shift-plane region in the seam, is somewhat oversimplified and does not take fully into account certain further operating restrictions which may become important. How the inventive system actually analyzes the problem presented to it, will now be explained with reference to FIGS. 7–9.

FIG. 7 is a semi-functional block diagram of the part of the inventive system responsible for assessing program error and modifying the stored interface-shape program correspondingly. FIG. 8 is a detailed block diagram of the program evaluating and modifying part of the system. To avoid confusion, it is noted that the part of the system responsible for correcting control-error (deviation between sensed operation and the interface-shape program presently in effect) is for the most part not illustrated here, and can be the same as shown in U.S. Pat. No. 4,008,921, FIGS. 10 and 11. The entire disclosure of U.S. Pat. No. 4,008,921 is incorporated herein by reference.

It is appropriate to briefly review here the operation of FIGS. 10 and 11 of U.S. Pat. No. 4,008,921, to make clear the relationship of the inventive control system thereto. In FIG. 10 of that patent, the preselected program for the upper interface is stored in a program storage C; the transverse-inclination program is stored in a program storage E. A comparable program for the lower face is not involved, it being assumed in that patent that the lower-cutter height is to be kept constant at a desired value, this value being indicated by the signal from unit H; in the present system, a lower interface-shape program is involved, necessitating a program storage instead of the simple signal-generating unit H of that patent. In FIGS. 10 and 11 of that patent, the desired-value signal for upper or lower cutter height is read out from the respective program storage, under the control of a position indicator A (i.e., in dependence upon the position of the power along the length of the face conveyor) and compared against signals indicating the present heights of the cutters, to generate signals indicative of upper and lower cutter-height error, which are then used to correct cutter height immediately. Likewise, the desired-value signal for transverse inclination is compared against the signal produced by a transverse inclinometer, and then used during the subsequent working trip to superimpose upon the height-error control of the cutters an elevation or lowering such as to correct the transverse-inclination error. All this can be the same, without any change, in the system of the present invention, the present invention differing therefrom with respect to ongoing updating of the programs being followed and how this updating is performed. FIGS. 10 and 11 of U.S. Pat. No. 4,008,921 illustrate the part of the system hereafter responsible for ensuring that the continually updated programs are actually followed.

In FIG. 7 of the present disclosure, a position indicator 100 generates a signal indicating the positon of the power loader relative to one end of the face conveyor, as the power loader travels along the length of the face conveyor. The position-indicating signal may, for example, be a multi-bit word, each bit of which is derived from a perforation (or the absence of one) in a multi-track perforated tape which is wound off a supply reel and onto a take-up reel in synchronism with power-loader travel, as explained in U.S. Pat. No. 4,008,921. Three program storages 101, 102, 103 respectively store the upper cutter height program, the lower cutter height program, and the transverse-inclination program. The position-indicating signal from position indicator 100 is applied to read-out units 104, 105, 106 serving to read out the contents of the three program storages 101, 102, 103 in synchronism with power-loader travel. The thusly read out data is applied to respective units 107, 108, 109 which convert this data into desired-value signals for upper cutter height, for lower cutter height, and for transverse inclinations; these units may be, for example, digital-to-analog converters. In FIGS. 7 and 8, for the sake of simplicity, units whose presence will be understood to persons skilled in the art have been deleted; for example, not all the write-in and read-out units need for information transfer are shown, nor all the digital-to-analog and analog-to-digital converters needed; their presence will be understood. The three desired-value signals at the outputs of units 107, 108, 109 are, as indicated by the bracket, applied to a cutter positioning system, e.g., the one shown in FIGS. 10 and 11 of U.S. Pat. No. 4,008,921. Additionally, the desired-value signals for upper and lower cutter height are applied, respectively, to an upper cutter height program error calculator 110, and to a lower cutter height program error calculator 111; essentially, units 110, 111 can be simple subtractors. The program error calculators 110, 111 additionally receive, from the seam-top sensor 61 and seam-bottom sensor 62, signals indicating the true seam top and bottom height at the present point in the travel of the power loader, and produce at their outputs signals indicating how far off the upper and lower interface-shape programs are from the actual seam interfaces at this point. The desired-value signal for transverse inclination, produced at the output of unit 109, is not similarly applied to a program error calculator, for reasons which will become clearer below; mainly, the transverse-inclination program is not separately modified as a function of detected transverse inclination, but instead is modified in dependence upon the modifications in the upper and lower interface-shape programs.

The program-error signals for the upper and lower interface programs, produced at the outputs of units 110, 111, are respectively applied and written-in to an upper cutter height program error memory 112, and a lower cutter height program error memory 113. These memories 112, 113 accordingly accumulate, during the course of one working trip of the power loader, a complete description of the error in the upper and lower interface programs. This stored information is made accessible to a program evaluator and modifier 116 (explained in greater detail with respect to FIG. 8). The writing-in of program-error data into the memories 112, 113 will of course be performed in synchronism with power-loader travel, under the control of position indicator 100 and suitable write-in units, but for simplicity such units and addressing lines, etc., are omitted from the drawing.

The inclinometer unit 60 includes an inclinometer 60*a* for transverse inclination, and an inclinometer 60*b* for forwards-backwards inclination. The signals which these inclinometers furnish are continually written-in to respective inclination memories 114, 115 during the ongoing course of a power-loader working trip, so that the inclination profile of the face conveyor can be memorized. This data, likewise, is made accessible to the program evaluator and modifier 116.

At, for example, the end of one power-loader working trip, the program evaluator and modifier 116 evaluates the three programs presently in effect, by taking into account the memorized program error in the upper and lower cutter height programs and the memorized transverse and forwards-backwards inclination profiles of the face conveyor and then, if appropriate, generates a new lower cutter height program and/or a new upper cutter height program and/or a new transverse-inclination program. Such new programs are then fed back to respective write-in units 117, 118, 119 and written-in to the affected one or ones of the three program storages 101, 102, 103, these new programs then governing during the next-following working trip.

FIG. 8 depicts in detail how the evaluation and modification of the present programs is actually performed. The evaluation and modification for the three programs are interrelated, but for the sake of clarity the lower cutter height program will be discussed first, it being in a sense the most problematic one. Attention is directed to FIG. 9 which represents the type of data considered and produced in the course of evaluating and modifying the lower cutter height program. The illustrated numerical data pertains to only a limited interval of the whole lower cutter height program, here the interval involved by the shift-plane 14 of FIG. 6.

Horizontal line A in FIG. 9 represents the data stored in lower cutter height program storage 101 (FIG. 7). For simplicity of explanation, the following is assumed: that the true seam-bottom has been perfectly continuous, flat and horizontal (as shown at 17 in FIG. 6) for all working trips previous to the trip represented in FIG. 6; that the lower cutter height program has been in exact correspondence to this interface situation during the preceding working trips; that the true-seam-bottom situation depicted in FIG. 6 is suddenly and for the first time encountered during the working trip represented in FIG. 6; and that the true-seam-bottom situation depicted in FIG. 6 will be, for working trips subsequent to the one represented in FIG. 6, the same as depicted in FIG. 6. These assumptions, although somewhat unrealstic, will facilitate visualization of how the system deals with an interface problem.

With these assumptions, the old lower cut program (i.e., the one about to be evaluated and perhaps altered) will be seen to consist of data tabulated in horizontal line A of FIG. 9. According to this present lower cut program, the lower cutting drum 31 is to be kept at a constant height of zero vertical-distance units relative to the face conveyor 2, throughout the whole working trip of the power loader 3. The face conveyor 2 serves as an artificial horizontal, relative to which vertical height of the two cutters is measured, irrespective of whether face conveyor 2 happens to be actually horizontal or not.

Returning to FIG. 8, the memorized lower cutter height program error for a whole working trip (the trip governed by the program in line A of FIG. 9) is read out from program error memory 111 at high speed, i.e., not in synchronism with power-loader travel, and fed through a trouble zone identification unit 120. The character of the data in question is tabulated in horizontal line B of FIG. 9. The portion of this data corresponding to the shift-plane zone is indicated at the top of FIG. 9 by "SHIFT IN SEAM", the memorized program-error values subsequent to the start of the problem being denoted by lower-case letters a through v. Each lower-case letter identifies a successive memorized position of power loader 3, as ascertained by the position indicator 100. It is to be recalled, when interpreting FIG. 9, that the power loader in FIG. 6 is travelling right-to-left. Upstream of location a, the true seam-bottom corresponded exactly to the stored lower cutter height program; accordingly in line B of FIG. 9, to the right of column a, program-error values stored in memory 111 are all zeroes, except for one value of −50 assumed to result from an inaccurate sensing of true seam-bottom at this point of power-loader travel. When the seam-bottom sensor 62 (FIG. 1) reaches the shift-plane 14 of FIG. 6, it begins to sense the lowered seam-bottom, and accordingly the presence of error in the bottom-cut program starts to be ascertained. At locations a, b, c, the bottom sensor 62 may operate somewhat inaccurately, and this is denoted at Ba, Bb, Bc in FIG. 9 by numerical values of program error not corresponding particularly well to the bottom drop shown in FIG. 6. From location d on, the bottom sensor 62 is operating accurately, and the numerical values of program error at Bd, Be, Bf, etc., are now quite accurate. The data in line B, corresponding to the contents of program-error memory 111, indicate that the true seam-bottom is 50 units below the lower interface-shape program at location a, 100 units below at location b, 150 units below at location c, and so forth. Beginning at location d, the amount of the program error will be seen to steadily decrease; this corresponds to the fact that, in FIG. 6, downstream of the seam-bottom drop, the true seam-bottom 12 climbs steadily back up to the level represented by the present lower cutter height program 17.

Returning to FIG. 8, as already indicated, the memorized program-error values for the whole working trip are fed from memory 111 through the trouble zone identification unit 120. The latter examines this data (line B of FIG. 9), in order to identify the intervals of the present program containing significant error. The criterion for significant error can simply be that the error amount to, for example, at least 10 vertical-distance units for a stretch of at least twenty successive power-loader locations (e.g., a through t in FIG. 9). Thus, for example, in line B of FIG. 9, four locations ahead of location a, a program error of 50 vertical-distance units is encountered, this resulting from faulty bottom sensing at this one location. The trouble zone identification unit 120 ignores this sizable but isolated program-error value, i.e., so that the system will not purposeless try to adapt itself to this value; indeed, even if the −50 program-error value were accurate, the system should anyway not be adapted to so isolated and short-term an error. However, the trouble zone extending across locations a through v is clearly recognized and identified. In effect, the trouble zone identification unit 120 converts the aforementioned −50 to a zero (no error), to suppress this error data when the memorized program-error data is run through the remainder of the units shown in FIG. 8, i.e., so that such remaining units will not at all respond to this insignificant error.

Returning to FIG. 8, after the memorized program-error values have been thusly "cleaned up" by unit 120, and the actual trouble zone identified, the memorized program-error data is fed into a corrected bottom cut-surface proposer unit 121. Unit 121 then proposes new values for that interval of the present program found to exhibit significant error. Essentially, all that cut-surface proposer 121 actually does is to immediately propose that the seam-bottom drop off shown in FIG. 6 be bridged over by the less steeply descending cut surface 19 already referred to. The proposal made by proposer 121 is made in accordance with a very simple criterion, namely that the change in the value of the lower cutter height program not be in excess of 10 vertical-distance units per successive power-loader location. The simplicity of this will best be appreciated by considering horizontal line C of FIG. 9, which represents the program modification first proposed by unit 121. Going through powerloader locations a through v, it will be seen that the lower cutter height values of the old program (line A) were all zero. Line C shows the modification proposed by proposer unit 121, i.e., a simple straight descent at a rate of 10 vertical-distance units per successive powerloader location: a drop to −10 at location a, to −20 at location b, to −30 at location c, etc., on through location 1, at which point the brought-down program can merge simply into the true seam-bottom, precisely as shown in FIG. 6. After location 1, the successive program-error values will be seen to be of decreasing magnitude, in correspondence to the upwards climb of true seam-bottom 12 in FIG. 6 back up to the original lower-cut program level 17.

The criterion followed by new-program propoer 121, i.e., that the lower cutter height by lowered 10 units per successive power-loader location until the new program merges into the detected true seam-bottom, is of course a very simple one to implement, in terms of calculation. The physical significance of the criterion is simple: This steepness of cut-surface descent, relative to the artificial horizontal constituted by the neighboring sections of the face conveyor (as distinguished from true horizontal) is the maximum rate of relative descent which the face conveyor and the power loader guided on it can negotiate. I.e., this is a limit in the flexibility of the face conveyor, a limit in its ability to folllow vertical undulations along the length of the floor surface. It will be understood that the numerical values given, e.g., 10 distance units, are merely explanatory.

Actually, the first proposal made by proposer unit 121 will always be this one, the only difference being whether the proposed slope of bridging surface 19 (FIG. 6) is a downwards or upwards slope.

This first proposed bottom cut-surface program, (line C in FIG. 9) is next fed through a series of checkers 122, 123, 124, 125 (see FIG. 8), which ascertain the acceptability of the proposal, with regard to different respective factors. In the case of the example represented by FIGS. 6 and 9, the first proposal for a new bottom-cut surface is, in fact, rejected.

The four checkers 122, 123, 124, 125 operate as follows:

The first checker 122 determines whether, if this proposed new program were actually followed during the next working trip, a problem of transverse drop-off could arise. As already explained (see FIG. 6), although the bottom-cut surface 19 does constitute a negotiable floor surface for travel of the power loader along the length of the face conveyor, an immediate transverse drop-off (i.e., in the next working trip) from the previous floor surface 17 all the way down to a floor surface 19, 12, would be clearly inoperative.

The manner is which transverse drop-off checker 122 checks for this will be understood from FIG. 9. It is assumed, for purposes of explanation only, that a transverse floor drop-off is unacceptable if its magnitude is 20 vertical-distance units or more. Accordingly, the transverse drop-off checker 122 merely compares the floor heights of the present floor program (line A in FIG. 9) against the floor heights of the (first) proposed new floor program (line C in FIG. 9), and it ascertains those power-loader locations at which the magnitude of the transverse drop-off, i.e, in going from the old floor surface to the (first) proposed new one, would be an unacceptable 20 vertical-distance units or more. As indicated by the circles in line C of FIG. 9, except for location a itself, all subsequent locations would exhibit an unacceptably large transverse drop-off. Accordingly, the first proposed new program is quite unacceptable. A program-reject signal is produced at the output of checker 122 and applied to the input of a slope-changer unit 126, which responds by commanding that proposer unit 121 propose a bridgeover cut-surface which is not so steeply descending as the one just proposed, i.e., not so steeply descending as 19 in FIG. 6.

As a result, cut-surface proposer 121 makes its second (less steep) proposal, shown in horizontal line D of FIG. 9. Here, the slope is only a vertical descent of 9 distance units per successive power-loader location, in contrast to the 10-unit slope of the first proposal.

Transverse drop-off checker 122 now runs through this second proposal, checking it for acceptability in the manner already explained. As indicated by the circles in line C of FIG. 9, except for the first two locations a and b, the magnitude of the transverse drop-off would again be unacceptable, for nearly the whole of the trouble zone in question. Accordingly, checker 122 again applies a proposal-reject signal to slope-changer 126, and cut-surface proposer 121 now proposes a bridgeover cut-surface having a slope of only 8 units, which is likewise rejected. This making of cut-surface proposals and their rejection continues, as indicated by the three dots between line D and L in FIG. 9, until at last cut-surface proposer 121 proposes a cut-surface (see line L in FIG. 9) having a descending slope of only 1 vertical-distance unit per successive power-loader location. As indicated by the absence of circles in line L of FIG. 9, this proposed program at no point would result in a transverse floor drop-off in excess of 20 vertical-distance units, and therefore is now not rejected by the transverse drop-off checker 122; i.e., this time, checker 122 does not apply a program-reject signal to the input of slope changer 126. In so far as checker 122 is concerned, this program proposal is acceptable.

Before discussing checkers 123–125, a few words should be said about the just described operation of transverse drop-off checker 122. In the explanatory example just given, program-proposal rejection by checker 122 results in a simple reduction in slope of the proposed bridgeover cut-surface, and the one finally accepted by checker 122 is shown in line L of FIG. 9. Comparison of line L against lines A and B will reveal that this new lower-cut program, followed by the system during the next-subsequent working trip, is much closer to the old program (line A) than to the sensor-detected new interface conditions (line B). At this rate, the system will require e.g. seven or eight power-loader working trips, before the bottom-cut program is maximally matched to the new interface conditions. In practice, this may be a satisfactorily quick system response, especially compared to the prior-art system of U.S. Pat. No. 4,008,921 which exhibits no interface-dependent program alteration.

However, persons skilled in the art will appreciate that a somewhat more sophisticated, although still quite simple, proposal-modification scheme could be followed, i.e., more sophisticated than the simple slope-decrease scheme explained above. For example, instead of the new-program values tabulated in line L of FIG. 9, a new program which will win more coal during the next power-loader working trip would, for example, be −10 for power-loader locations a through f, and −19 for power-loader locations g through v. What the truly optimal proposal-modification scheme will be, depends upon the specific floor- and roof-negotiating capabilities of the particular equipment involved. Furthermore, it is again noted that the numerical values given in FIG. 9 are explanatory only.

The corrected bottom-cut programs proposed by program proposer 121 are also run through a checker unit 123, which checks the proposed bottom-cut program for the possible development of excessive transverse inclination. It will be understood that the transverse drop-off checker 122 already described constitutes, in effect, a checker for excessive relative transverse inclination, i.e., excessive transverse inclination relative to the artificial horizontal constituted by the face conveyor 2 itself. In the explanatory situation depicted in FIG. 6, it has been assumed that the old floor surface 17 was in fact perfectly horizontal; in that case, there is no difference between transverse inclination relative to the artificial horizontal (face conveyor) and relative to true horizontal. However, if the system had been programmed to follow a seam whose bottom interface is not horizontal, but instead somewhat transversely inclined, i.e., transversely descending, the transverse inclination of the face conveyor might already be non-zero. In that case, whereas the drop-off ascertained by checker 122 (i.e., transverse inclination relative to artificial horizontal) may be acceptable, the true physical transverse inclination which the face conveyor and power loader would develop might be greater than acceptable. It is for this reason that checker unit 123 is provided. Transverse-inclination checker 123 ascertains the relative transverse inclination which would develop if the proposed program were accepted, in essentially the same way that transverse drop-off checker 122 operates; additionally, however, checker 123 relates (e.g., adds) this relative transverse-inclination data to the true transverse-inclination data memorized by memory 114 (FIG. 7) during the power-loader working trip in question. If the absolute transverse inclination implied by the proposed bottom-cut program would be excessive, then checker applies a program-reject signal to the input of slope changer 126 (FIG. 8), in the same way as just explained with respect to checker 122. As a result, the slope of the proposed bridgeover cut-surface will be made less steep in the new such proposal, in the manner already explained, until transverse-inclination checker 123 stops rejecting the proposals. In the explanatory situation being described, no absolute transverse-inclination problem has been encountered.

Furthermore, the bottom-cut proposals from proposer unit 121 are also fed through an excessive forwards-backwards inclination checker 124. It will be recalled that the first bridgeover-cut proposal made by proposer unit 121 corresponded to 19 in FIG. 6, which already took into account the maximum forwards-backwards floor inclination which the equipment could negotiate, relative to the artificial horizontal constituted by the adjoining segments of the face conveyor itself. However, in the same way already explained with regard to transverse inclination, if the face conveyor's forwards-backwards inclination is not actually zero, then the mildly descending cut proposed in line L of FIG. 9, although of very small slope relative to the artificial horizontal, may exceed the limit of the true physical forwards-backwards inclination which the equipment can negotiate. Forwards-backwards inclination checker 124 checks for true forwards-backwards inclination consequences by superimposing the slope of the proposed cut (line L in FIG. 9 exhibits a downwards slope of 1 vertical-distance unit per successive power-loader location) upon the absolute forwards-backwards inclination values memorized by memory 115 (FIG. 7) during the power-loader working trip in question. If the absolute forwards-backwards inclination of the proposed bottom-cut surface exceeds a predetermined value, corresponding to the maximum absolute inclination the system is to be permitted to develop, the checker 124 likewise applies a proposalreject signal to the input of slope changer 126, and in the manner already described the steepness of the proposed bridgeover cut is reduced in the next such proposal.

Also, the bottom-cut program proposed by proposer 121 is run through an inclination-twist checker 125. For example, it may happen that one section of the lengthy face conveyor exhibits upwards transverse inclination (because here the system is rising to adapt itself to a rise in true seam-bottom), whereas a close or adjoining section of the face conveyor is exhibiting a downwards transverse inclination (because here the system is descending to adapt itself to a lowering of the true seam-bottom). Whereas both the upwards transverse inclination and downwards transverse inclination values may be acceptable in themselves, from the viewpoints so far mentioned, the opposite-direction inclinations may tend to result in excessive face-conveyor twist. In FIG. 6, the section of the face conveyor downstream of the shift-plane 14 will, during the next several powerloader working trips, be in the course of a downwards transverse descent, but the face conveyor section upstream of shift-plane 14 will still be kept horizontal. However if, for example, the face conveyor section upstream of shift-plane 14 were already in the process of performing an upwards transverse ascent, the downwards transverse inclination of the bridgeover cut proposed by proposer 121, although acceptable to checkers 122–124, might be unacceptable to inclination-twist checker 125. In that event, checker 125 likewise would apply a proposal-reject signal to the input of slope changer 126, causing the slope of the next bridgeover-cut proposal to be less steep, so that the inclination-twist limit of the equipment employed will not be exceeded.

The four checker units 122–125 in FIG. 8 are shown connected in parallel. They can perform their respective checks of the successive bridgeover-cut proposals successively or concurrently, the important consideration being only that all checker units 122–125 are satisfied with the proposal. When all checker units are satisfied, and cease to apply proposal-reject signals to slope changer 126, a tentative bottom-cut proposal acceptor 127 tentatively accepts the bottom-cut program proposal. In terms of logic function, tentative proposal acceptor 127 essentially performs the function of a NAND-gate.

Besides generating a modified program for the bottom-cut, the system here also generates a modified program for the top-cut. Essentially, this is performed in the same way as just explained with respect to the bottom-cut. As indicated in FIG. 8, the data memorized by the upper cutter height program error memory 110 is run through a trouble zone identification unit 128 and, after being "cleaned up" in the way explained with respect to unit 120, is run through a corrected top-cut-surface proposer 129. The latter produces a succession of topcut proposals, which are run through a group of checkers 130, and the latter apply input signals to a slope changer 131, causing the slopes of successively proposed top-cuts to be successively decreased, until all checkers 130 are satisfied, whereupon the top-cut proposal is accepted by a tentative top-cut proposal acceptor 132. The top-cut proposer 129, checkers 130, slope changer 131 and proposal acceptor 132 operate in a manner substantially identical to what has already been described with respect to the bottom bridgeover cut. The main difference, relative to the bottom bridgeover cut, is that the criteria for acceptability of proposed top-cuts will in general be less stringent and fewer than for the bottom-cut, problems such as excessive transverse drop-off, excessive transverse inclination, and so forth, at the top-cut not presenting a direct threat to the face conveyor and power loader. Mainly, the limits placed upon the rate at which the system is to be allowed to adapt itself to changes in the seam-top conditions, are determined by the ability of the self-advancing roof-support system to negotiate a non-smooth roof surface. Thus, in FIG. 6, whereas the final or steady-state version 19, 12 of the bottom-cut might not be achieved for seven or eight working trips of the power loader, the final or steady-state version 18, 13 of the top-cut may be achieved somewhat more quickly.

Now that proposals for both the bottom and top bridgeover cuts have been tentatively accepted, the tentatively accepted proposals are fed by units 127, 132 (FIG. 8) through a minimum vertical-clearance evaluator 133. The latter compares the difference in the new upper and lower cutter heights, for corresponding power-loader locations along the length of the face conveyor, to verify that the height difference at no point falls below the minimum negotiable value of $H_{mi}$. If unit 133 ascertains that the minimum-clearance criterion would not be met by the tentatively accepted bridgeover-cut proposals, it applies a signal to the input of slope changer 131, to alter the slope of the top-cut proposal in a sense increasing vertical celarance. When the minimum-clearance criterion is met, evaluator 133 transmits the new top-cut and bottom-cut programs to the respective write-in units 117, 118 (FIG. 7), and the new programs are written-in to their respective program storages 101, 102, replacing the old programs.

All that remains to be done is to generate, if necessary, a new transverse-inclination program. The new inclination program is not derived in the manner of the new top-cut and bottom-cut programs, but instead is here derived from the old and new bottom-cut programs and the old transverse-inclination program, by an inclination program generator 134. The latter merely compares the values of the old and new bottom-cut programs at successive corresponding power-loader locations, to determine for each such location the transverse inclination implied by the difference between corresponding values of the old and new programs, this difference then being superimposed upon the corresponding value of the old inclination program, to form the corresponding value in the new inclination program. The new inclination program is then fed out from program generator 134 to write-in unit 119 (FIG. 7) and written-in to the inclination program storage 103, replacing the old inclination program.

It is necessary that the transverse-inclination program be thusly modified, especially when using a cutter positioning system such as shown in FIG. 10 of U.S. Pat. No. 4,008,921. That positioning system automatically resists inclination control-error by jointly raising and lowering the upper and lower cutting drums. Thus, if the transverse-inclination program is not updated to take into account the new programs for upper and lower cutter height, the old inclination program would cause the cutting drums to be jointly raised and lowered in a sense which would counteract the updating of at least the bottom-cut program. In the system illustrated in FIGS. 7 and 8 herein, it will be clear that the new transverse-inclination program generated by unit 134 need not be run through checkers, in the manner of the topcut and bottom-cut programs; this is because the transverse drop-off checker 122 and excessive transverse-inclination checker 123 for the bottom-cut program have already performed the requisite inclination checks and corrections.

The new programs having been generated and stored, the longwall system is now advanced and the power loader performs its next working trip. During this next working trip, the data described above are accumulated anew, and the programs needed for the third such working trip are then developed and implemented; and so forth.

It is to be understood that the system depicted in FIGS. 7 and 8 constitutes merely one exemplary embodiment of the invention. Clearly, many modifications of this system producing an equivalent end result would be possible. For example, the system could be made more complex, to achieve a more sophisticated and swift adaptation of the governing programs to changing interface conditions and/or to cut down even further upon the amount of human monitoring and control needed for the equipment. Alternatively, the system could be made somewhat simpler, so as to serve not as an automaton but merely an aid to operating personnel. Also, a variety of auxiliary features can be provided. For example, in the unlikely event that the system detects a change in interface conditions, and records the presence of this change for a plurality of working trips, but is unable to generate changed programs meeting all the operating and safety criteria described above, an automatic shut-off and/or warning signal feature could be provided, calling upon operating personnel to temporarily override the automatic programs and manually control the equipment for at least one working trip. Then, when a manually controlled working trip deemed by the operator to be a good one has been performed, the operator can for example flip a switch, to cause the memorized cutter-height and inclination values employed by him to now constitute the new top-cut, bottom-cut and inclination programs, after which the system can be switched back to automatic operation.

FIGS. 7 and 8 depict a special-purpose process-control computer comprised of discrete cooperating units. However, persons skilled in the data-processing art will appreciate that the functions performed by these units can be very readily implemented upon a small general-purpose programmable digital computer; these functions, as has been explained, consist entirely of many simple additions, subtractions, comparisons and elementary trigonometric computations performed upon stored sets of data. Using a correspondingly programmed, small general-purpose digital computer would have the further advantage of flexibility. The arithmetic which the system must perform to evaluate and modify the existing programs, in the course of its ongoing updating operation, is very elementary and easy to understand. Implementation of this arithmetic is simple and elementary in itself. Harder, is to fully take into account the floor and roof-negotiating capabilities of all the equipment in a particular system, e.g., the numerical values of the limits of the permissible operating parameters. Using, instead of the discrete-unit special-purpose process-control computer of FIGS. 7 and 8, a correspondingly programmed general-purpose digital computer, would allow supervisory personnel to periodically modify the program-modifying scheme, as experience with particular equipment in for example a particular mine is accumulated, so as to push the whole system's performance as near as possible to its potential limit.

If a correspondingly general-purpose digital computer is utilized, then advantageously the computer can also be programmed to take over the monitoring and control of operations not per se relating to the need for program updating, for example the subtractions, comparisons, calculations and data storing performed by the positioning system shown in FIGS. 10 and 11 of U.S. Pat. No. 4,008,921, plus monitoring and control of the self-advancing roof-support system and other such equipment. Typically, for example, the control of these components is performed manually or else by uninterrelated control mechanisms. The use of a general-purpose computer, programmed to operate equivalently to the discrete-unit system of FIGS. 7 and 8, but also programmed to embrace all the various other monitoring and control functions normally needed for a longwall mining system, besides being centralized, would offer further advantages. For one, data interrelating the various units of equipment and their operation could be monitored, for example position data indicating relative positions as among face conveyor, power loader, roof-support system, i.e., each relative to all the others. This makes possible a more comprehensive and interrelated control of all this equipment. Likewise, by using a programmed general-purpose computer, corresponding to the operation of manual and discrete-component automatic control of all this equipment, there is again the advantage of being able to update or modify the more or less routine control schemes used for such equipment, i.e., to take into account experience accumulated with particular equipment in a particular geography, e.g., in a particular mine; this cannot readily be done when the control of the various operations performed by all this equipment is implemented by uninterrelated discrete control mechanisms of relatively unalterable operation.

It will be understood that each of the elements described above, or two or more together, may also find a useful application in other types of circuits and constructions differing from the types described above.

While the invention has been illustrated and described as embodied in an automatic self-reprogramming monitoring and control system used in conjunction with particular longwall mining equipment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved method of controlling the operation of a longwall excavating machine which during a working trip works the face of a longwall excavation, particularly a power loader mounted for movement along the length of a face conveyor, or the like, the method being of the type wherein a coal-seam interface-shape program is stored in a programmable control arrangement operative for causing the excavating machine to excavate in accordance with the stored program during at least one working trip, the improvement comprising:

using coal-seam interface sensor means to generate data indicative of true coal-seam interface-shape conditions;

feeding said data into the programmable control arrangement and causing the latter to compare said data against the stored coal-seam interface-shape program and ascertain the error in the stored coal-seam interface-shape program relative to the true coal-seam interface conditions detected by the sensor means;

and causing the programmable control arrangement to automatically and gradually modify the stored coal-seam interface-shape program in ongoing depedence upon the ascertained error to thereby automatically and continually update the stored coal-seam interface-shape program followed by the excavating machine.

2. The method defined in claim 1, the automatic and gradual modification of the stored coal-seam interface-shape program comprising:

registering in the programmable control arrangement the error as between the stored coal-seam interface-shape program and the true coal-seam interface conditions detected by the sensor means, and causing the programmable control arrangement to ascertain, relative to predetermined criteria relating to the permissible rate of interface-shape program change, the amount by which the error in the stored coal-seam interface-shape program can safely be changed and then actually change the stored interface-shape program by that amount.

3. The method defined in claim 1, the automatic and gradual modification of the stored coal-seam interface-shape program comprising:

registering in the programmable control arrangement the error as between the stored coal-seam interface-shape program and the true coal-seam interface conditions detected by the sensor means, and causing the programmable control arrangement to ascertain, relative to predetermined criteria relating to the rate of interface-shape program change permissible in going from one excavating-machine working trip to the next, the amount by which the error in the stored coal-seam interface-shape program can safely be changed for the next working trip and then actually change the stored interface-shape program by that amount for the next working trip.

4. The method defined in claim 1, the automatic and gradual modification of the stored coal-seam interface-shape program comprising:

storing in the programmable control arrangement data relating to the error as between the stored coal-seam interface-shape program and the true coal-seam interface conditions detected by the sensor means, using the programmable control arrangement to ascertain the intervals of the working trip of the excavating machine corresponding to the error, and causing the programmable control arrangement to ascertain, relative to predetermined criteria relating to the rate of interface-shape program change permissible in going from one excavating-machine working trip to the next, how much of the ascertained error in the stored coal-seam interface-shape program can safely be eliminated per working trip for the next working trips of the machine and then actually change the erroneous intervals of the stored interface-shape program by such amounts for successive working trips, whereby to gradually and stepwise does out over a plurality of working trips the corrective reduction in the amount of the error exhibited by the stored interface-shape program.

5. The method defined in claim 1, the longwall excavating machine being a power loader having upper and lower cutters, the automatic and gradual modification of the stored coal-seam interface-shape program furthermore including the step of causing the programmable control arrangement to automatically and gradually modify the stored coal-seam interface-shape program in dependence upon the distance between the upper and lower cutters in such a manner that the modifications of the stored interface-shape program will not result in the distance between the upper and lower cutters falling outside a predetermined range of permissible distance values.

6. The method defined in claim 1, the longwall excavating machine being a power loader mounted for movement along the length of a face conveyor, and furthermore including a self-advancing roof-support system cooperating with the face conveyor and power loader, the method furthermore comprising using the programmable control arrangement to also monitor and automatically control the operation of the face conveyor and of the self-advancing roof-support system.

7. An improved longwall mining system, of the type comprising a longwall excavating machine which during a working trip works the face of a longwall excavation, particularly a power loader mounted for movement along the length of a face conveyor, the system furthermore being of the type including programmable control means operative for storing a coal-seam interface-shape program and causing the excavating machine to excavate in accordance with the program during at least one working trip, the improvement comprising:

coal-seam interface sensor means on the excavating machine operative for generating data indicative of true coal-seam interface-shape conditions as the excavating machine performs a working trip and feeding said data into the programmable control means, the programmable control means comprising means receiving said data, comparing said data against the stored interface-shape program, and ascertaining the error in the stored interface-shape program relative to the true coal-seam interface conditions detected by the sensor means, and means operative for automatically and gradually modifying the stored coal-seam interface-shape program in ongoing dependence upon the ascertained error to thereby automatically and continually update the stored coal-seam interface shape program followed by the excavating machine.

8. The longwall mining system defined in claim 7, the means automatically and gradually modifying the stored interface-shape program comprising means operative for ascertaining, relative to predetermined criteria relating to the permissible rate of interface-shape program change, the amount by which the error in the stored coal-seam interface-shape program can safely be

10. The longwall mining system defined in claim 7, the means automatically and gradually modifying the stored interface-shape program comprising means registering data relating to the error as between the stored coal-seam interface-shape program and the true coal-seam interface conditions detected by the sensor means, means ascertaining the intervals of the working trip of the excavating machine corresponding to the error, means operative for automatically ascertaining, relative to predetermined criteria relating to the rate of interface-shape program change permissible in going from one excavating-machine working trip to the next, how much of the ascertained error in the stored interface-shape program can safely be eliminated per working trip for the next working trips of the machine, and means automatically operative during the subsequent working trips of the excavating machine for changing the erroneous intervals of the stored interface-shape program by such amounts in a stepwise dosed manner, whereby to gradually and stepwise dose out over a plurality of working trips the corrective reduction in the amount of the error exhibited by the stored interface-shape program.

11. The longwall mining system defined in claim 7, the longwall excavating machine being a power loader having upper and lower cutters, the means automatically and gradually modifying the stored interface-shape program comprising means automatically operative for correlating interface-shape program changes with the distance between